United States Patent [19]

Deli

[11] 4,250,977

[45] Feb. 17, 1981

[54] COMBINED SEAT AND STEP-LADDER ARRANGEMENT

[76] Inventor: Peter Deli, 4 chemin de la Montagne, 1224 Chene-Bougeries, Canton of Geneva, Switzerland

[21] Appl. No.: 58,692

[22] Filed: Jul. 18, 1979

[51] Int. Cl.[3] ..... A47C 13/00

[52] U.S. Cl. ..... 182/33.6; 182/106

[58] Field of Search ..... 182/33.6, 33.5, 33, 182/33.3, 33.2, 113, 106

[56] References Cited

U.S. PATENT DOCUMENTS

| | | | |
|---|---|---|---|
| 1,280,797 | 10/1918 | Michenfelder | 182/33.6 |
| 2,505,607 | 4/1950 | Early | 182/33.6 |

*Primary Examiner*—Reinaldo P. Machado

*Attorney, Agent, or Firm*—Steele, Gould & Fried

[57] ABSTRACT

The arrangement comprises a rigid structure having a support portion, e.g. in the form of a chair. On opposite sides of the support portion are hingedly mounted two step units. The step units are so designed and arranged that in their inoperative position they can be stowed under the support portion. When needed, one unit is pivoted through 90° from under the support portion and comes to bear on the ground beside the rigid structure, and the other unit is pivoted through 270° from under the support portion and comes to bear on the support portion. Each unit may have two steps and the two units may thus provide a flight of four steps. The rigid structure, when in the form of a chair, may have a back rest provided with a vertically slidable hand rest.

4 Claims, 2 Drawing Figures

COMBINED SEAT AND STEP-LADDER ARRANGEMENT

BACKGROUND OF THE INVENTION

This invention relates to an article of furniture consisting of a combined seat and step-ladder arrangement.

Articles of furniture of this kind typically consist of step-stools having a foldable set of steps (usually two steps) hingedly mounted between two of the stool legs. When needed the steps are pivoted out from under the stool seat through approximately 180°, with the stool seat portion becoming the top step.

Such stools whilst quite practical suffer from a drawback: they are often not high enough, e.g. for taking down or putting up curtains or drapes in houses or apartments having ceilings of say 250 cm (roughly 12 feet) or more, depending on the height of the person.

The usual remedy is to acquire a normal step-ladder. Step-ladders however are not dual purpose and must be stowed away after use, which often means putting them in an inconvenient place, unlike a step-stool which can usually be kept within reach.

SUMMARY OF THE INVENTION

An object of the invention is to provide a combined seat and step-ladder arrangement which combines the advantages of a step-stool and of a step-ladder without the above disadvantages.

According to the invention there is provided a combined seat and step-ladder arrangement comprising a rigid structure having a support or seat portion, and comprising first and second step units hingedly mounted on opposite portions of the rigid structure, said units each having two steps and being adapted, in their inoperative position, to be stowed under the support or seat portion, and, in their operative position, the first to come to bear on the ground beside the rigid structure and the second to come to bear on the rigid structure such as to be disposed above the support or seat portion, the steps of the first unit being arranged to be disposed in alignment with the steps of the second unit in the operative position, to form a continuous flight and to be disposed in substantially parallel adjacent relationship with the steps of second unit in the inoperative position.

BRIEF DESCRIPTION OF THE DRAWINGS

In the accompanying diagrammatic drawings, given by way of example.

DETAILED DESCRIPTION OF PREFERRED EMBODIMENTS

Figure 1:
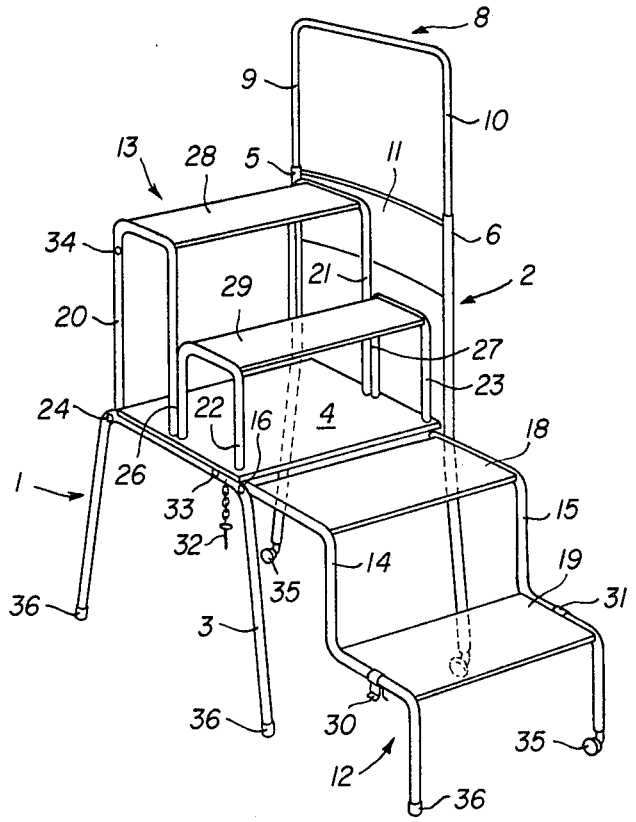
FIG. 1 is a perspective view of a combined chair and step-ladder arrangement in accordance with the invention, showing the step-ladder component in its operative position.

The combined chair and step-ladder arrangement shown in the drawings comprises a rigid structure 1 consisting of a tubular metal assembly 2 providing laterally flared back legs and a back rest for the chair, a tubular metal U-shaped element 3 spaced from the assembly 2 and providing laterally flared front legs for the chair, and a seat portion 4, e.g. a rectangular plate, rigidly connecting the assembly 2 and element 3.

The assembly 2 may for instance comprise a pair of substantially upright tubes 5 and 6 rigidly connected, as by welding, to a tubular cross-piece 7, the latter also providing a support for the seat portion 4. Above the cross-piece 7 the tubes 5 and 6 are vertical and parallel and are open at the top so as slidingly to receive the free ends of a tubular metal U-shaped hand-rest element 8 having parallel arms 9 and 10. A padded back support 11 extends rigidly between the upper end portions of tubes 5 and 6.

Step units 12 and 13 are hingedly mounted on opposite sides of the rigid structure 1.

Unit 12 has a pair of spaced W-shaped tubular metal elements 14 and 15 respectively hinged at 16 and 17 to element 3 and to cross-piece 7 beneath seat portion 4, the elements 14 and 15 being rigidly secured to each other in parallel relationship by plates 18 and 19 to form a pair of steps.

Unit 13 has first and second pairs of spaced U-shaped tubular metal elements 20–21 and 22–23, the latter being approximately half as high as the former. Elements 20 and 21 are respectively hinged at 24 and 25 to element 3 and to cross-piece 7 beneath seat portion 4, and elements 22 and 23 are respectively secured as by welding along 26 and 27 to elements 20 and 21, the pairs of elements 20–21 and 22–23 being rigidly secured to each other in parallel relationship by plates 28 and 29 to form another pair of steps.

Figure 2:
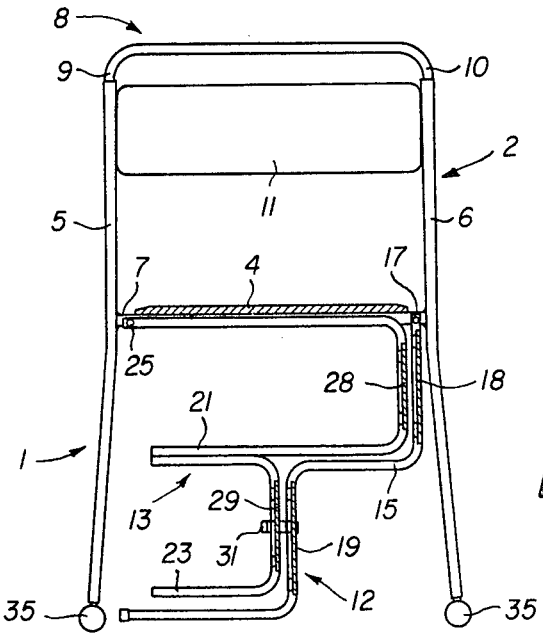
FIG. 2 is a vertical section of the combined chair and step-ladder arrangement of FIG. 1, showing the step-ladder component in its inoperative position.

When needed, step unit 12 is pivoted anticlockwise from the position shown in FIG. 2 under seat portion 4 through 90° after momentarily tilting structure 1 sideways to the left, and step unit 13 is pivoted clockwise from under seat portion 4 through 270°, with structure 1 in an upright condition, to bring both ends of elements 22 and 23 and the adjacent ends of elements 20 and 21 into engagement with the top surface of seat portion 4, and the free ends of elements 14 and 15 into engagement with the ground as shown in FIG. 1, thus providing a continuous flight or series of four steps. Further the element 8 is raised slidingly out of tubes 5 and 6. The height to which element 8 may be raised is dependent on the length of arms 9 and 10 and the extent to which the latter may enter tubes 5 and 6. Thus if the latter are made parallel down to the ground, element 8 may be so made as to rise to almost twice the height of back support 11, i.e. to over 170 cm (about 67 inches). Means (not shown) may be provided to releasably lock or hold element 8 at different heights. Such means are well-known in the art and will therefore not be described further.

As will be observed from FIG. 2, step units 12 and 13 are designed to fit snugly into each other under seat portion 4, the latter having here a width approximately equal to the height of units 12 and 13 as viewed in FIG. 1. If seat portion 4 is at a height of say 48 cm (about 19 inches), the top step 28 of the flight will be at say between 92 and 94 cm (about 36 to 37 inches) above the ground, i.e. high enough easily to reach the ceiling in most houses and apartments.

In the folded or inoperative condition, units 12 and 13 are releasably locked together by any suitable means to prevent them from dragging on the ground and keep them firmly stowed under seat portion 4 while not in use, e.g. pairs 30 and 31 of spring leaves, having flared mouths, which are mounted on elements 14 and 15 and which clip elastically over adjacent portions of elements 20 and 21, slots being provided along the adjacent edges of plate 29 to allow engagement of the elements 20 and 21 by the leaves of pairs 30 and 31.

Unit 13 may also be releasably locked to the structure 1 by any suitable means, e.g. by a pin 32 which may be inserted through a horizontal hole 33 in element 3 and into a corresponding horizontal hole 34 in element 20.

To facilitate movement of the combined chair and step-ladder castors 35 or other rolling elements may be provided on the free end of element 15 and at the lower end of tubes 5 and 6, whereas rubber pads 36 or the like are preferably provided on the free ends of elements 3 and 14 to prevent the combined chair and step-ladder from moving when units 12 and 13 are in use.

The materials used for the illustrated chair and step-ladder arrangement are largely a matter of choice and will generally involve metal, wood and plastics. If desired, seat portion 4 may be upholstered since the seat portion 4 is not used as a step, unlike the prior art arrangements described in the introduction.

As will be appreciated, various modifications may be made to the illustrated chair and step-ladder arrangement described above. For instance, the chair component may be provided with arm rests arranged substantially upright at opposite ends of seat portion 4 and so dimensioned as not to interfere with the movements of the tubular elements of unit 13. In that case and if desired, the free arms of elements 22 and 23 may be dispensed with, plate 29 then being made to rest on the adjacent arm rest. Elements 20 and 22 and elements 21 and 23 could be made to consist of single elements, in similar manner to elements 14 and 15. The free ends of tubular elements of unit 13 may also be provided with pads or caps to protect seat portion 4. The seat component may also consist of a stool having no backrest.

I claim:

1. A combined seat and step-ladder arrangement comprising a rigid structure having a support portion, and comprising first and second step units hingedly mounted on opposite portions of the rigid structure, said units each having two steps and being adapted, in an inoperative position, to be stowed under the support portion, and, in an operative position, the first to come to bear on the ground beside the rigid structure and the second to come to bear on the rigid structure such as to be disposed above the support portion, the steps of the first unit being arranged to be disposed in alignment with the steps of the second unit in said operative position to form a continuous flight and to be disposed in substantially parallel adjacent relationship with the steps of the second unit in said inoperative position.

2. An arrangement as claimed in claim 1, wherein said units are hingedly mounted on opposite sides of the support portion.

3. An arrangement as claimed in claim 1 or 2, comprising means for releasably locking said units relatively to the rigid structure in said inoperative position.

4. An arrangement as claimed in claim 1, comprising a back support having a vertically slidable hand rest portion at the top thereof.

* * * * *